United States Patent [19]

Lührig et al.

[11] 4,242,443

[45] Dec. 30, 1980

[54] PHOTOGRAPHIC FILM UNIT WITH INTEGRAL STRUCTURE

[75] Inventors: Hermann Lührig, Leverkusen; Guido Kovacic, Unkel; Horst-Peter Müller, Cologne, all of Fed. Rep. of Germany

[73] Assignee: AGFA-Gevaert, A.G., Leverkusen, Fed. Rep. of Germany

[21] Appl. No.: 80,192

[22] Filed: Oct. 1, 1979

[30] Foreign Application Priority Data

Oct. 5, 1978 [DE] Fed. Rep. of Germany ..... 2843476

[51] Int. Cl.[3] ..... G03C 1/48

[52] U.S. Cl. ..... 430/496; 430/207; 430/209

[58] Field of Search ..... 430/207, 208, 209, 496, 430/497, 498

[56] References Cited

U.S. PATENT DOCUMENTS

| | | | |
|---|---|---|---|
| Re. 27,795 | 10/1973 | Chen | 430/497 |
| 3,619,193 | 12/1968 | Knight | 430/209 |
| 3,652,281 | 3/1972 | Bachelder et al. | 430/209 |
| 3,652,282 | 3/1972 | Land | 430/208 |
| 3,689,269 | 9/1972 | Schieven | 430/209 |
| 3,741,766 | 6/1973 | LaMonaca | 430/208 |
| 3,816,128 | 6/1974 | Chen | 430/209 |
| 4,042,396 | 8/1977 | Sylvester | 430/208 |

*Primary Examiner*—William R. Dixon, Jr.
*Attorney, Agent, or Firm*—Connolly and Hutz

[57] ABSTRACT

The invention relates to a photographic film unit with a picture sheet and a covering sheet which are joined together by means of an interposed mask, and a container for photographic developer material is located at the front end and a trap for collecting excess developer material is located at the rear end of the picture unit and whereby air guiding channels connect the trap compartment with the container compartment to conduct the surplus air or also developer past towards the empty developer container.

15 Claims, 6 Drawing Figures

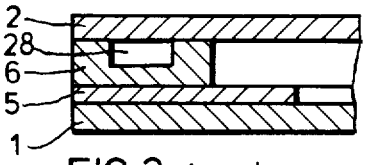
FIG. 2 (A-A)
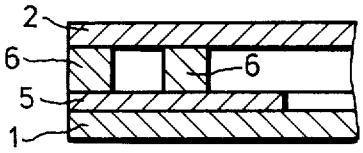
FIG. 3 (B-B)
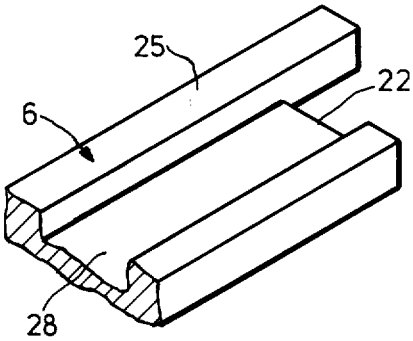
FIG. 4
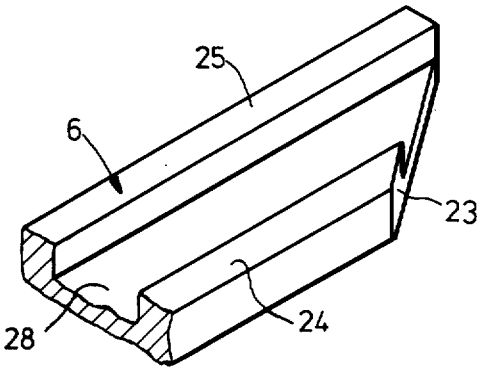
FIG. 5
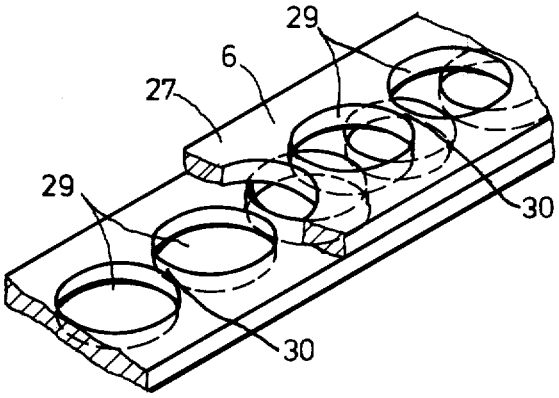
FIG. 6

PHOTOGRAPHIC FILM UNIT WITH INTEGRAL STRUCTURE

The present invention relates to a photographic film unit with integral structure having a picture sheet and a covering sheet which are joined together by means of an interposed mask as well as laterally arranged spacer strips, wherein a container for photographic developer material is located at the front end of the picture unit and a trap for collecting excess developer material is located at the rear end of the picture unit and the container and the trap are covered by elongate flap members of the mask which protrude from the contours of the picture unit and are folded back on to the covering sheet and rigidly fixed to it.

Photographic film units with integral structure of the above-mentioned type are already known. After exposure of the film unit, development is generally performed by spreading a photographic developer material over the film unit using a pair of rollers in the camera which exert pressure.

Air is displaced by the diffusion of the developer material and has to be given the opportunity to escape through ventilation devices. In this process, the following photographic developer material must be prevented in an effective manner from issuing from the ventilation devices. Ventilation devices of this type have already been described as slits or perforations in the trap cover or as laterally interrupted edge seals of the trap chamber in German Offenlegungsschrift No. 19 57 975, U.S. Pat. No. 3,652,282 and U.S. Pat. No. 3,689,269. Although these designs ensure reliable outlet of air developer material can only be prevented from issuing at the same time in an inadequate manner. Labyrinth-type designs have been proposed to overcome this defect, in which the air has to follow multiple deflections before it can issue through slits or perforations. The high viscosity developer material should be prevented from flowing out afterwards and thus prevented from issuing unintentionally, as a result of the multiple deflection. However, in practice, highly alkaline developer material still issues in an undesirable way from the film unit when using these labyrinth-type designs of trap of the type described in German Offenlegunsschrift No. 25 20 839 and German Offenlegungsschrift No. 26 31 009, in spite of the relatively high outlay. This leads not only to the inconvenient soiling of parts of the camera, hands and also of clothing, but, in addition, the strong alkalinity of the developer material represents a considerable danger to children who might get the alkaline solution in their mouths and eyes.

An object of the invention is to provide a film unit, from which no developer paste can issue and with which soiling and injury by the paste can be prevented by simple means.

This object has been achieved according to the invention in that the film unit is provided, in the region of the lateral connections between picture sheet and covering sheet, with air guiding channels which connect the trap compartment with the paste containing compartment.

It has been found that a photographic film unit which is hermetically sealed to the exterior can be produced using this measure. The developer paste pressed out of the container by the rollers in the camera displaces the air enclosed in the photographic film unit. This air firstly flows into the trap and hence through the air guiding channels beneath the pressure rollers of the camera into the compartment of the paste container. Since this compartment is already empty, the displaced air can be received without difficulty.

The lateral channels can be formed in various ways according to the invention. According to a preferred embodiment, longitudinal grooves or furrows are introduced into the lateral spacer strips, for example by milling, Heat-forming, by folding over the two sides or by other methods.

In a preferred embodiment, the channels for guiding the air are formed in such a way that the two lateral spacer strips between picture sheet and covering sheet each comprise two separate length-wise members and the air guiding channels are produced by the space between the two length-wise members.

The formation of the channels by the lateral spacer strips represents a simple means of forming the channels. Of course, the mask could also be designated so that it assumes the function of maintaining the space between picture sheet and covering sheet and also of guiding the air from the trap beneath the rollers to the paste containing compartment. In order to allow air to enter the lateral channels, the spacer strips can be provided at both ends towards the trap compartment and the container compartment with stamped out openings or bevels so that the air and any excess paste can easily reach and leave the channels. The upright parts of the spacer strips support the squeezing rollers above the channel compartment so that the air can penetrate beneath the rollers.

The use of two superimposed strips of sheeting each as spacer strips with offset, overlapping rows of holes for the overflow of air and developer liquid, represents another surprising advantage.

It was surprising for the skilled man to see that the arrangement of these air guiding devices in the spacer strips allows the air and the developer material to be conveyed both simply and efficiently.

The developer paste is prevented very reliably from flowing out by the hermetic seal of the film unit without air outlet holes or the like.

By the way of example, embodiments of the present invention are described in more detail with reference to the attached drawings.

FIG. 2 shows a partially sectional view of a film unit according to the invention with a lengthwise groove in the spacer strip as air guiding channel.

FIG. 3 shows a partially sectional view of a film unit according to the invention, having two separate lengthwise members spaced apart to form spacer strip and interposed air guiding channel.

FIG. 4 shows a perspective detailed view of a spacer strip provided with an air guiding channel and having a notch for the intake and outlet of air.

FIG. 5 shows a perspective detailed view of a spacer strip provided with an air guiding channel and having a bevel to provide for the intake and output of air.

FIG. 6 shows a perspective view of a spacer strip composed of two strips with superimposed rows of holes which are offset relative to each other to form an air guiding channel.

Figure 1:
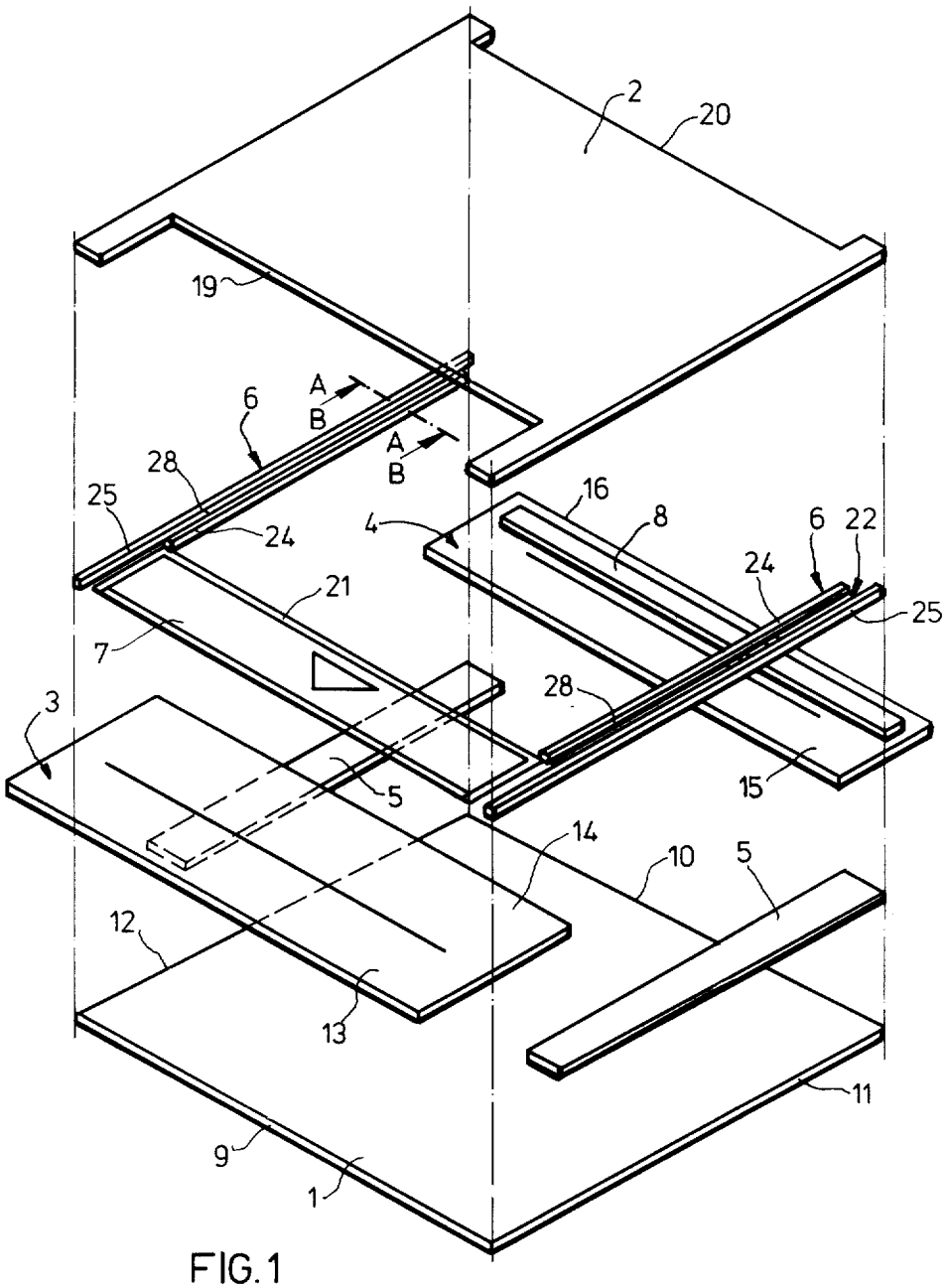
FIG. 1 shows an exploded view of a film unit with a multiple-part mask and air guiding channels formed in spacer strips.

According to the embodiment of FIG. 1, the film unit comprises a picture sheet 1 and a covering sheet 2 which are substantially congruently superimposed.

The film unit has a front edge 9 connected to a container 7 for the developer material and a rear edge 10 connected to a trap 8. After exposure, the developer material needed for development is distributed from the container 7 over the picture unit to the required thickness in such a way that the film unit is guided with the front edge 9 through pressure-exerting members, (in a known manner), through a pair of pressure rollers. In this process, the pressure increase in the container 7 causes a bursting seam 21 to be broken and the developer material to be distributed in the film unit upstream of the pair of pressure rollers.

Excess developer material is collected in the trap 8 connected to the rear edge 10 of the picture unit.

The lateral edges 11, 12 of the picture sheet 1 and covering sheet 2 are joined to each other either by means of a single homogeneous mask or as illustrated, by means of a multiple-part in homogeneous mask combination 3, 4, 5 and to separate lateral spacer strips 6.

Opening formed on the front edge 9 and the rear edge 10 of the picture unit by the shortened central portions 19, 20 of the covering sheet 2 are sealed by folding over two flap members 13, 16 and sticking them to the outer sides of the covering sheet 2. In this way, the container 7 is covered and the compartment for the trap 8 is formed.

The container 7 for the developer material can be formed in a known manner by folding a single sheet material, the lateral seams being sealed permanently and the front length-wise seam being designated as the bursting seam 21.

The container compartment may be divided into several chambers; also permanent seals may be provided in the paste compartment or in the region of the bursting seam in order to ensure that the paste is distributed as uniformly as possible when it issues into the picture region.

The trap is formed by a rigid insert 8 which withstands the roller pressure and receives the developer material and which is covered so as to be tight to liquid by means of the wrapping flap 16 of the mask wrapping sheet 4 on the trap side. The incompressible trap insert 8 spreads apart the pair of rollers which are usually spring mounted to prevent excess developer material which has been collected in the trap 8 from flowing back into the image area in an undesirable manner.

According to the invention, the spacer strips 6 are designed as air guiding channels 28 for air and excess developer material.

FIG. 2 shows a detailed section along the line A—A (FIG. 1) through the photographic film unit. A mask 5 is arranged on the picture sheet 1. On the mask 5, is arranged the spacer strip, provided with a channel 28, which in turn is connected with the covering sheet 2.

FIG. 3 shows as detailed section B—B (FIG. 1) at the same point, an embodiment of the invention in which two separate length-wise members 6 are adjacent to each other. The space between them forms the channel for the displaced air and remaining material.

FIGS. 4 and 5 show embodiments of the ends of the spacer strips which are needed to ensure that air is forced into channels. Accordingly, it is possible, as illustrated in FIG. 4, to arrange stamped out openings 22 at both ends of the spacer strips 6 so that the outer portion 25 of the spacer strip 6 is maintained for sealing the film unit from the exterior. It is possible to apply bevels 23, as illustrated in FIG. 5, which face the trap compartment and container compartment and allow the air and the developer material to enter into and issue from the channels.

Stamping 22 or bevels 23 are not needed with the two-part spacer strips according to FIG. 3. With these embodiments, it is sufficient simply to design the internal length-wise members 6 shorter.

The embodiment according to FIG. 6 demonstrates the use of two strips of sheeting 27 provided with openings 29, as spacer strips 6, each strip of sheeting 27 having in the embodiment illustrated a row of holes 29 with a distance between centres of the holes which is smaller the twice the diameter of the holes 29 being offset to each other by half a hole internal and thus allowing the air developer material displaced from the film unit to flow through the pair of strips of sheeting in the length-wise direction from the trap towards the container compartment in the manner of a labyrinth.

The strips of sheeting 27 are fixed on the mask 5 on one side and on the covering sheet on the other side in such a way that neither air nor paste can flow out. They can be fixed by bonding, adhering with "Hotmelt" of by other methods.

The air channels worked into the film units, according to the invention, extend from the trap side to the container side in all embodiments. A hermetically sealed film unit which is completely tight to the exterior is provided by fixing the spacer strips 6 uninterruptedly on both sides, the air and any excess developer material being guided through the channels into the compartment of the developer container.

However, it is also an object of the invention to guide the air in the channels downstream of the developer container and not to fix parts of the outer spacer strip at the end of the channels in the region of the developer container, in order to allow excess air to issue there after passing through the channels. Although this is accompanied by the disadvantage that the film unit is not hermetically sealed to the exterior, the narrow cross-section and the volume of the two channels affords the advantage that it is substantially more difficult for developer paste to issue than with the film units according to the prior art.

The present invention has considerable advantages over known film units since, on the one hand, danger of soiling by the developer paste (which often has a pH value of 14) is avoided and, on the other hand, a sufficient amount of developer material to cover the picture portion of the film unit completely and uniformly and thus to ensure good development can be used without risk.

I claim:

1. A photographic film unit having an integral structure with a front and a rear end and a picture sheet and a covering sheet which are joined to each other by means of an interposed mask, wherein a container for photographic developer material is located at the front end of the picture unit and a trap for collecting excess developer material is located at the rear end of the picture unit the mask having elongate flap members which initially project out of the contour of the picture unit and are then folded back on to the covering sheet and are rigidly joined with it, the flap members covering the container and the trap, characterised in that the film unit has lateral connections between picture sheet and covering sheet disposed between the trap and the container and spacer strips with air guiding channels are disposed in the lateral connections.

2. A photographic film unit according to claim 1, characterised in that the air guiding channels comprise length-wise grooves or furrows formed in the spacer strips.

3. A photographic film unit according to claim 1, characterised in that the two lateral spacer strips each comprise two separate length-wise members and the air guiding channels are formed by the space formed between the two length-wise members.

4. A photographic film unit according to claim 1, characterised in that the air guiding channels are formed by openings in superimposed strips wherein the openings of one strip are relative to the openings of the next strip in such a way that the bridge pieces which exist between the openings of one strip are covered on both sides by openings provided in the adjacent strip and this ensures that the passage of air alternates from one strip to the next strip.

5. A photographic film unit according to claim 4, characterised in that the lateral spacer strips are formed from two superimposed strips of sheeting each with a row of holes having the same hole clearance and hole diameter, in that the distance between the centres of the holes amounts to less than twice the diameter of the hole and in that the rows of holes are offset relative to each other by half a distance between holes and the air or also developer paste displaced from the trap side can flow through the pair of strips of sheeting towards the paste container.

6. A photographic film unit according to claim 1, characterised in that the film unit is hermetically sealed to the exterior.

7. A photographic film unit according to claim 1, characterised in that the film unit has openings to the exterior at the end of the channels in the region of the container, which allow air to flow out.

8. A photographic film unit having an integral structure with a picture sheet and a covering sheet which are joined to each other by means of an interposed mask, wherein a container for photographic developer material is located at the front end of the picture unit and a trap for collecting excess developer material is located at the rear end of the picture unit, characterised in that laterally mounted spacer strips are disposed between the covering sheet and picture sheet and connected to the trap, and the spacer strips being provided with air guiding channels disposed between picture sheet and covering sheet receiving air from the trap.

9. A photographic film unit according to claim 8, characterised in that the air guiding channels comprise length-wise grooves or furrows formed in the spacer strips.

10. A photographic film unit according to claim 8, characterised in that the two lateral spacer strips each comprise two separate length-wise members and the air guiding channels are formed by the space formed between the two length-wise members.

11. A photographic film unit according to claim 8, characterised in that the air guiding channels are formed by openings in superimposed strips wherein the openings of one strip are relative to the openings of the next strip in such a way that the bridge pieces which exist between the openings of one strip are covered on both sides by openings provided in the adjacent strip and this ensures that the passage of air alternates from one strip to the next strip.

12. A photographic film unit according to claim 11, characterised in that the lateral spacer strips are formed from two superimposed strips of sheeting each with a row of holes having the same hole clearance hole diameter, in that the distance between the centers of the holes amounts to less than twice the diameter of the hole and in that the rows of holes are offset relative to each other by half a distance between holes and the air or also developer paste displaced from the trap side can flow through the pair of strips of sheeting.

13. A photographic film unit according to claim 8, characterised in that the air guiding channels are hermetically sealed to the exterior.

14. A photographic film unit according to claim 8, characterised in that there are openings to the exterior at the end of the channels in the region of the container which allow air to flow out.

15. A photographic film unit according to claim 8, wherein the air channels connect the trap to the container.

* * * * *